US005409093A

United States Patent [19]

Joseph et al.

[11] Patent Number: 5,409,093

[45] Date of Patent: Apr. 25, 1995

[54] COIN CONSIGNMENT DEVICE

[75] Inventors: Alice Joseph, Schiltigheim; Alain Le Marchand, Reichstett; Pascal Schaeffer, Singrist, all of France

[73] Assignee: Ateliers Reunis Caddie, Strasbourg-Schiltigheim, France

[21] Appl. No.: 115,425

[22] Filed: Sep. 2, 1993

[30] Foreign Application Priority Data

Sep. 9, 1992 [FR] France ..... 92 10744

[51] Int. Cl.[6] ..... G07F 17/10

[52] U.S. Cl. ..... 194/259; 194/905

[58] Field of Search ..... 194/247, 249, 253, 257, 194/259, 904, 905

[56] References Cited

U.S. PATENT DOCUMENTS

| | | | |
|---|---|---|---|
| 4,474,280 | 10/1984 | Lenander | 194/247 |
| 4,474,282 | 10/1984 | Lenander | 194/247 |
| 4,637,507 | 1/1987 | Ricouard et al. . | |
| 4,641,739 | 2/1987 | Marie | 194/253 |
| 4,691,816 | 9/1987 | Trubiano . | |
| 4,766,989 | 8/1988 | Maloeuvre et al. | 194/257 |
| 4,941,560 | 7/1990 | Bailey | 194/905 X |
| 5,040,656 | 8/1991 | DiPaolo et al. | 194/257 X |
| 5,069,324 | 12/1991 | Lepage et al. . | |
| 5,121,823 | 6/1992 | Wanzl et al. | 194/253 |
| 5,131,517 | 7/1992 | DiPaolo et al. | 194/257 |
| 5,180,045 | 1/1993 | Sonnendorfer et al. | 194/905 X |
| 5,199,544 | 4/1993 | Lenander et al. | 194/905 X |
| 5,236,073 | 8/1993 | DiPaolo et al. | 194/905 X |

FOREIGN PATENT DOCUMENTS

| | | |
|---|---|---|
| 0468088 | 1/1992 | European Pat. Off. . |
| 2593949 | 8/1987 | France . |
| 2604010 | 3/1988 | France . |
| 400803 | 8/1924 | Germany . |
| WO86/04174 | 7/1986 | . |
| WO88/01084 | 2/1988 | . |
| WO90/07167 | 6/1990 | . |

*Primary Examiner*—Michael S. Huppert
*Assistant Examiner*—Scott L. Lowe
*Attorney, Agent, or Firm*—Young & Thompson

[57] ABSTRACT

The consignment device comprises a box (1) with two slots (2, 3) capable of receiving corresponding keys. The box is shaped to receive a key fitted with a receiver for a consignment coin so that the insertion of a second key unlocks a first coin-bearing key locked into a first slot, leaving the second key locked into position in a second slot. This device comprises at least one key catch (14, 15) translatable substantially perpendicular to direction of insertion of the key (*27a, 27b*), and at least one elements (5, 11) for locking the catch (14, 15) translatable substantially parallel to the direction of insertion of the key (*27a, 27b*).

19 Claims, 7 Drawing Sheets

COIN CONSIGNMENT DEVICE

BACKGROUND OF THE INVENTION

1. Field of the Invention

This invention relates to a coin consignment device, notably for a nestable-type cart.

2. Description of the Prior Art

French patent No. 81-22,384 describes a coin-triggered lock suitable for installation on a cart belonging to a cart system, especially shopping carts or luggage trolleys. This lock is designed to release an attached cart by insertion of a coin and to return the coin deposited when the cart is put back in place. The lock comprises two holes intended to accommodate two separate keys of which one is attached to the cart on which the lock is mounted; this key is equipped to accommodate a coin and to free a keyhole after insertion therein.

Each keyhole comprises a groove suitable for securing a lever bit in a blocked position in one of the keyholes to retain a key inserted therein. The lever bit can be displaced from its blocked position to a position blocking the other keyhole by means of stopping components which protrude into the separate keyholes and can be activated by a key inserted into the corresponding keyhole.

In these known locks, the lever bit pivots freely on a pivot, at right angles to the direction of insertion of the keys, between the two positions corresponding to the blocking of the one or of the other key.

These known locks thus have translational motion substantially parallel to the key insertion direction and limited pivotal motion about an axis transversal 16 to this key insertion direction.

Accordingly, the known locks have an elongated shape in the key insertion direction and are prone to being forced by insertion of tools capable of pivoting the lever bit.

OBJECT OF THE INVENTION

The object of the invention is to provide a new consignment device with enhanced safety against forceful breakage and smaller space requirements than the known device of the prior art.

A further object of the invention is to provide a nestable cart comprising a consignment device embodying the invention and a corresponding key comprising a consignment coin receiver, said key being connected by a chain or similar flexible link to the nestable cart.

SUMMARY OF THE INVENTION

The device of the invention is a coin consignment device, notably for a nestable cart, of the type comprising a box with two slots capable of receiving corresponding keys, said box being shaped to receive a first key fitted with a receiver for a consignment coin so that the insertion of a second key unlocks said first coin-bearing key locked into a first slot, leaving the second key locked into position in a second slot, wherein the device comprises at least one key catching means translatable substantially perpendicularly to the key insertion direction, and at least one means for locking said catching means translatable substantially parallelly to the key insertion direction.

According to further advantageous features of the invention:

the key slots are provided on two opposite sides of the box, the slots are substantially symmetrical in relation to a common longitudinal mid-plane perpendicular to both slots, the catching means comprises at least one H-shaped part, between the branches of which passes at least one latch cooperating with an associated retracting spring means, the catching means comprises two independent H-shaped parts between the branches of which pass two locking elements on either side of the middle bar of the H, the two H-shaped parts are drawn back into position by laterally supported spring means and cooperate with at least one lateral latch, the box comprises a coin receiver complementary in shape with the coin receiver of the corresponding key, the H shape comprises one bar-shaped leg and another leg comprising two inclined inner planes oriented in opposite directions to one another and corresponding to inclined key-engaging planes, a space corresponding to one inclined plane is smaller than the space associated with the inclined plane oriented in the opposite direction, the device is substantially symmetrical in relation to said longitudinal mid-plane, upon insertion of the key, the coin directly pushes a central latch entering into the coin receiver of the box, to unlock the catching elements situated on either side of the longitudinal mid-plane, a latch enters into a key slot, the key has a conformation bearing on the latch when the key is inserted into said slot, the key has a general U shape, the coin receiver being situated within the U shape, the engaging and insertion of a key on a first H-shaped inclined plane causes the H shape to move against the corresponding retracting spring, followed by the disengaging of the other key through withdrawal of the inclined plane oriented in the opposite direction, each key comprises a coin receiver, the device comprises four H-shaped catches, a lateral locking element is in the shape of a bar comprising a head provided with an inclined plane, a central locking element is of symmetrical shape corresponding substantially to the placing side by side of these two lateral latches along said longitudinal mid-plane of symmetry.

BRIEF DESCRIPTION OF THE DRAWINGS

Further features and advantages of the invention will be apparent from the embodiments described hereafter, by way of non limiting examples, with reference to the accompanying drawings in which.

DESCRIPTION OF THE PREFERRED EMBODIMENTS

Figure 1:
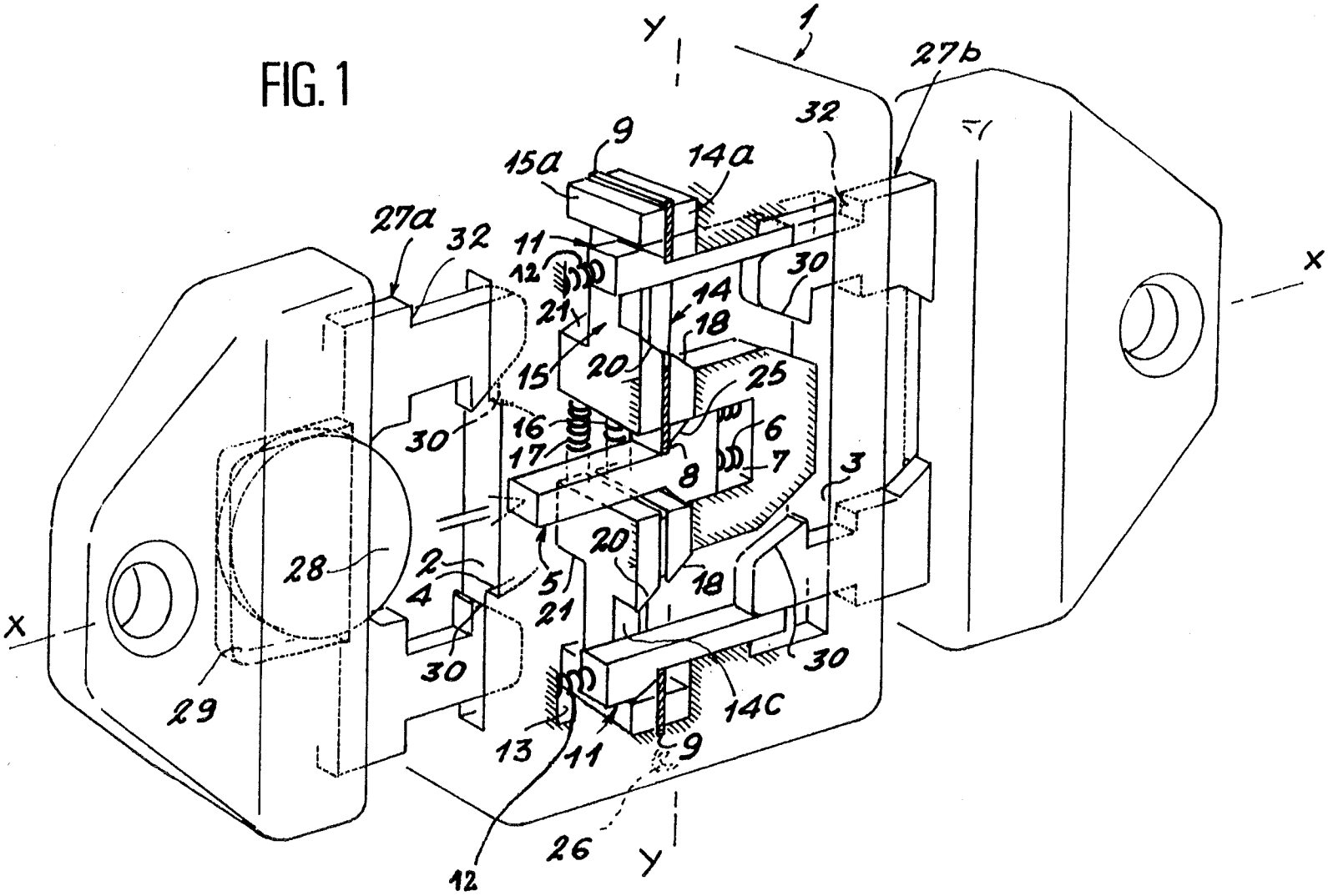
FIG. 1 represents a schematic perspective cutaway view of a device embodying the invention.
Figure 2:
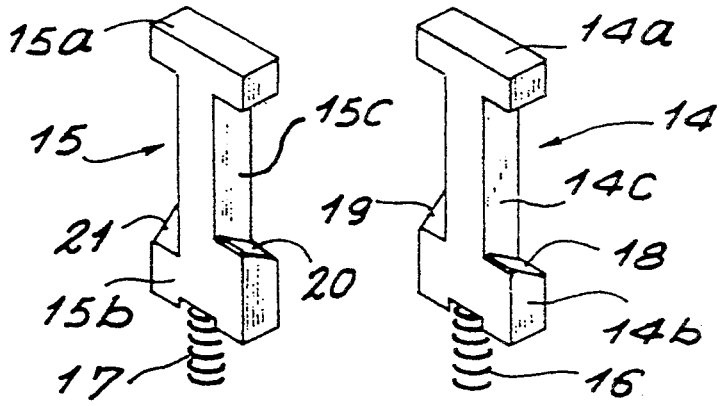
FIG. 2 schematically represents a perspective view of two catching elements of a device embodying the invention.
Figure 3:
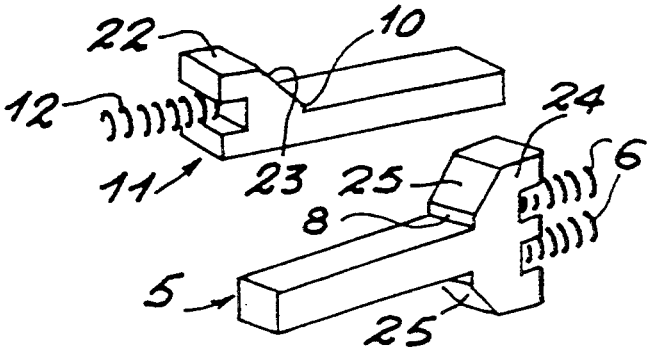
FIG. 3 schematically represents a perspective view of two locking elements of a device embodying the invention.
Figure 4:
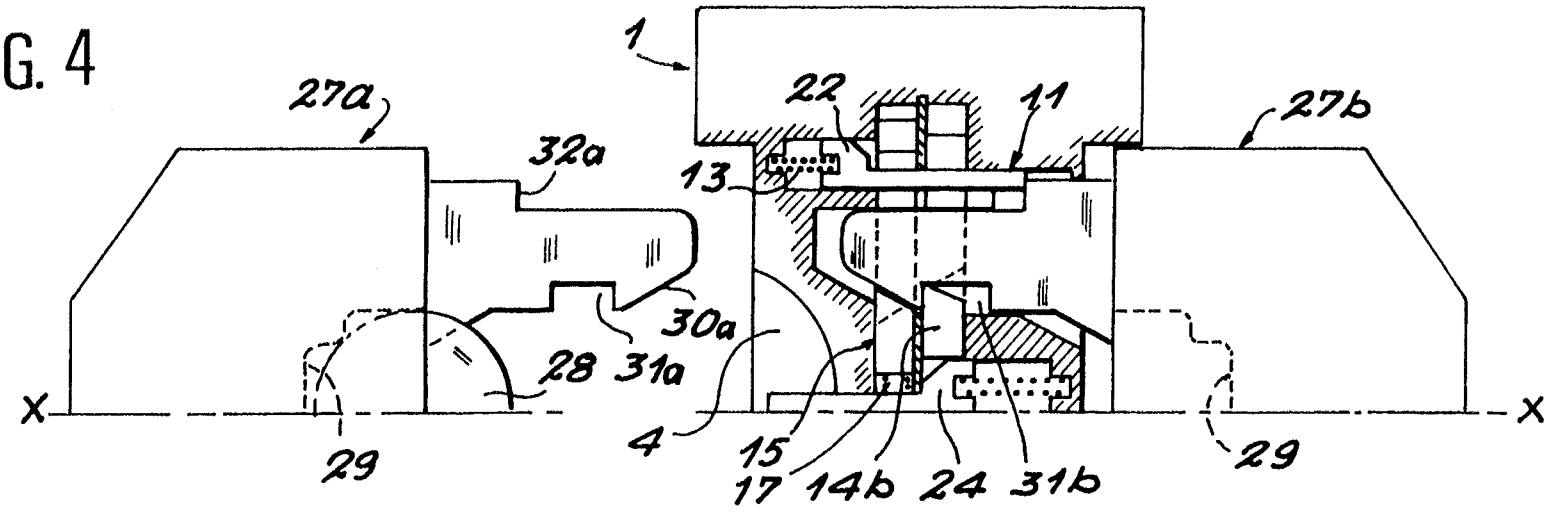
FIGS. 4 to 8 schematically represent a succession of stages corresponding to the freeing of a key with no consignment coin resulting from the insertion of a key with a consignment coin.

With reference to FIGS. 1 to 3, a box 1 of a device embodying the invention is substantially symmetrical in relation to a plane marked by its trace in fine dot-and-dash lines X—X in FIG. 1. Key slots 2 and 3 are provided on opposite sides of the box 1, in a substantially symmetrical position in relation to the plane X—X, which is a common plane perpendicular to both slots.

The box 1 comprises a housing 4 of cylindrical contour corresponding to the contour of a consignment coin or of a similar token. A central latch 5 enters into the housing under the action of a spring 6 disposed in a chamber 7 forming a compression housing. The latch 5 comprises a stop 8 that comes to rest against a separating plate 9 substantially disposed in a plane Y perpendicular to the above-mentioned plane X—X.

The separating plate 9 also corresponds to the resting position of a stop 10 of a lateral latch 11 subjected to the action of a spring 12 disposed in a housing 13: thus, the lateral latch 11 and the central latch 5 are displaceable on either side of the separating plate 9 between a position resting against this plate 9 and a position corresponding to the total compression of springs 6 or 12.

The locking elements 5 and 11 can thus be translated substantially parallel to the direction of insertion of the keys in slots 2 or 3. These elements 5 and 11 lock catches 14 and 15 moveable in a translational direction substantially perpendicular to the direction of insertion of the key. The catches 14 and 15 constitute a means for catching the keys inserted into the box.

The locking of the catches 14 and 15 then has the consequence of locking in the keys thus caught.

The catches 14 and 15 are both H-shaped with two branches **14*a*, 14*b* (respectively 15*a*, 15*b*) joined together by a crossbar 14*c* (respectively 15*c*). Branch 14*a* (15*a*), which constitutes one of the legs of the H, is in the shape of a substantially parallelepipedal bar, while the other leg comprises two interior planes 18, 19 (respectively 20, 21**) oriented in opposite directions to one another at angles corresponding to inclined planes of a key engaging housing.

The lateral lock 11 passes between the legs or branches **14*a* and 14*b*, as well as 15*a* and 15*b*. A lateral lock 11 is fitted with a head 22 provided with an inclined plane 23, so as to maintain a bar 15*a* in a position corresponding to the thrust of the spring 17, or to compress the spring 12 in the receiver 13 and thus enable the catch 15 to move by compressing the spring 17**.

Similarly, the central lock 5 outside the H shapes, 14 and 15, presses against the H-shaped parts by means of a head 24 provided with inclined planes 25. Preferably, this central locking element 5 is of symmetrical shape in relation to the symmetrical plane X—X: this shape corresponds e.g. substantially to the joining together of the shapes of two lateral latches 11 along the longitudinal mid-plane of symmetry of the device.

A tapping 26 or similar means for fixing is provided on one side of the box to secure an outer envelope that is not represented.

In view of the geometrical symmetries, or due to the fact that the only motions of the device are translational movements perpendicular to one another, it will be understood that the number of catches and latches can be increased within the scope of the invention.

A preferred embodiment of the device comprises two catches 14 and two catches 15 disposed symmetrically on either side of the plane X—X, a central lock 5 fitted e.g. with a single spring 6 and two lateral locks 11 disposed symmetrically in relation to the mid-plane X—X, the separating plate 9 then extending transversely and symmetrically in relation to the key insertion direction while being constructed in a single piece fitted with corresponding openings for the passage of the latches 5, 11 and of the keys, as will be explained hereinunder in reference to FIGS. 4 to 13.

Advantageously, the separating plate 9, instead of being independent of the body of the box 1, will be in a material machined or molded in a single piece with the body, with openings corresponding to the motion of the catches, latches and spring receivers.

With reference to FIGS. 4 to 8, a key **27*a* fitted with consignment coin 28 is in the shape of a U. The coin receiver 29 is disposed inside the U shape and has a cylindrical shape complementary to the shape of the receiver 4 in the box 1. One of the legs of the U comprises an inclined plane 30 adjacent to a catching recess 31 and, on the other side, a notch 32 for bearing on a lateral lock 11. The key 27*b* with no consignment coin is caught by the leg 14*b* of the H-shaped catch 14 engaging in recess 31*b*, this leg 14*b* is locked by the head 24 of the central latch 5, which thus simultaneously locks the catch 14 and the key 27*b*. Due to the fact that the head 22 of the lateral latch 11 is retracted into the housing 13, the H shape 15 can move against the spring 17**.

Figure 5:
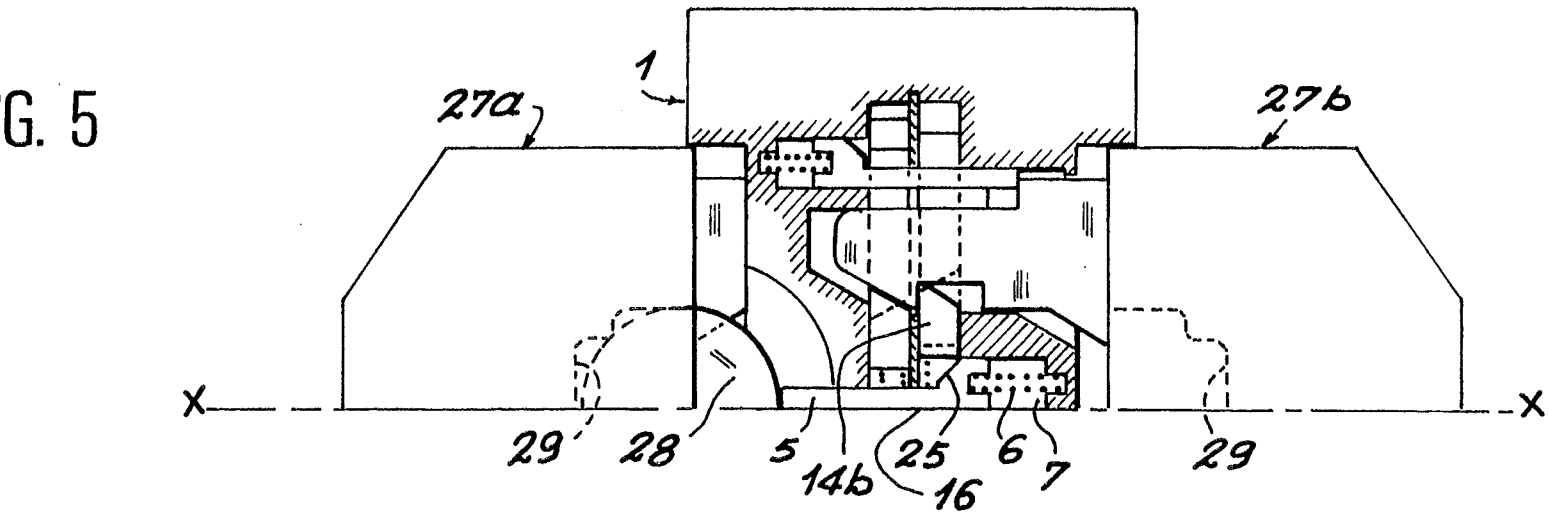

With reference to FIG. 5, when the key **27*a* is inserted into the corresponding slot of the box 1, the consignment coin 28 presses directly, by way of its diameter, against the central latch 5 which thus withdraws into the housing 7, thereby compressing the spring 6. Accordingly, the inclined plane 25 arrives at the level of the bar 14*b*, thereby constituting the start of the unlocking phase of the H-shaped part 14. However, the H-shaped part 14 continues to catch in the key 27*b* due to the fact that it is subjected to the pressure of the spring 16** disposed in a central position.

Figure 6:
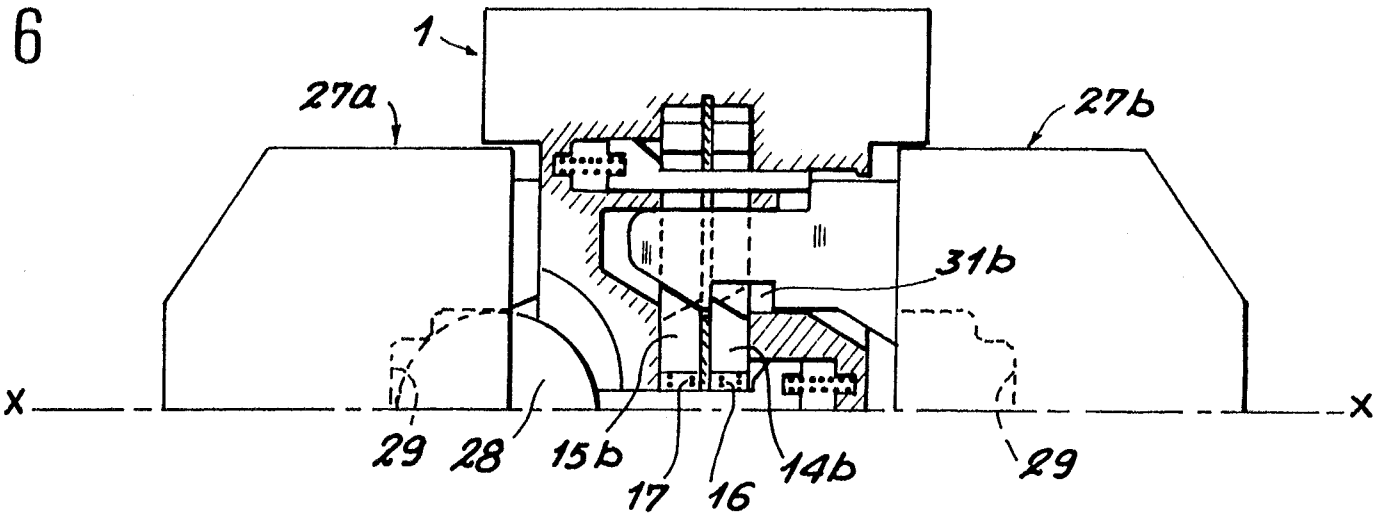

With reference to FIG. 6, the inclined plane 30 of the key **27*a* engages on the inclined plane 19 of the bar 14, causing the latter to move down while bar 15*b* arrives in the catching position of the recess 31*a* of key 27*a*. In this position, the device is completely symmetrical and both keys 27*a* and 27*b* are simultaneously caught in under the pressure of the corresponding springs 16 and 17. The catches 14 and 15 are not locked: however, these keys 27*a* and 27*b* cannot be withdrawn as the corresponding edges of bars 14*b* and 15*b* remain engaged inside the recesses 31*b* and 31*a***.

Figure 7:
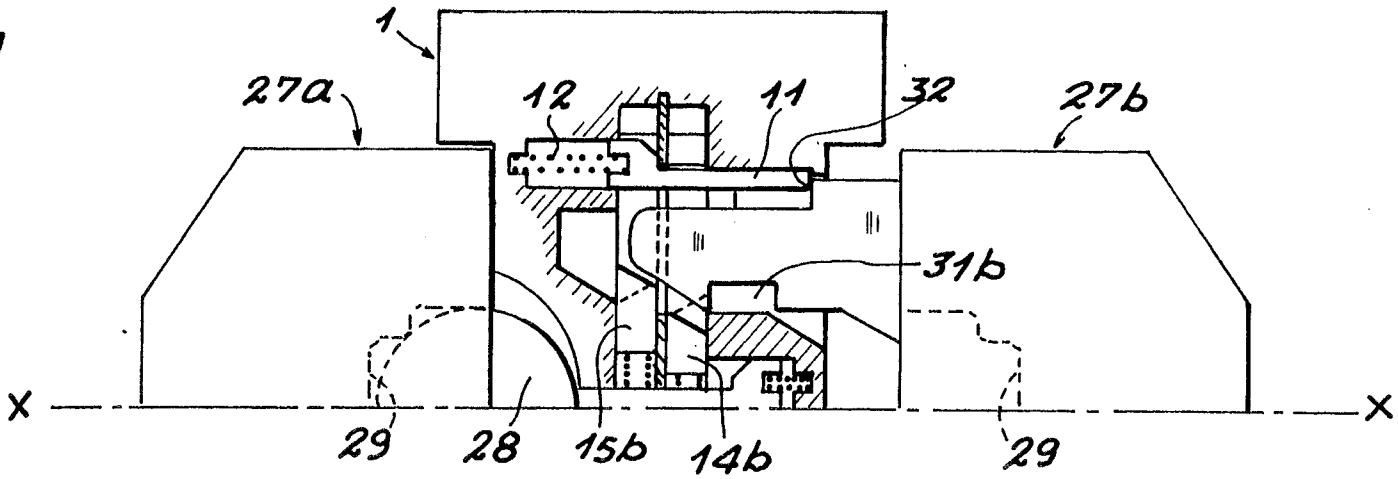

Reference to FIG. 7, the complete engaging of the key **27*a* completely pushes down the bar 14*b* which releases itself from the recess 31*b* and frees the disengaged key 27*b*. The latch 11 then under the action of the spring 12 drives the key back out of the box by pressing against the edge 32**.

Figure 8:
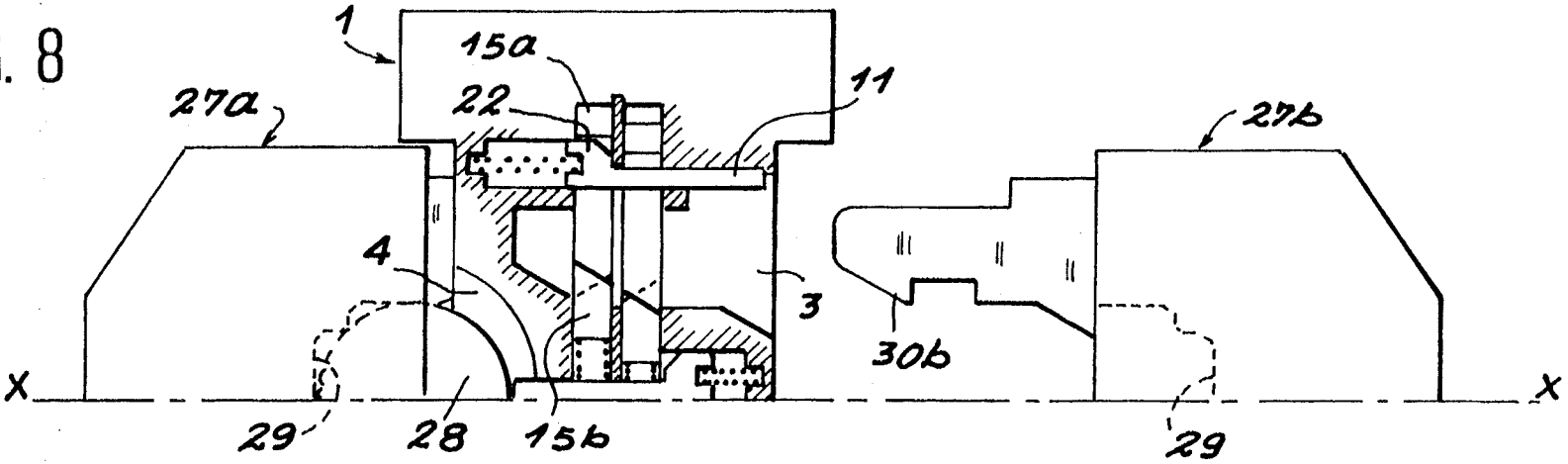
Figure 9:
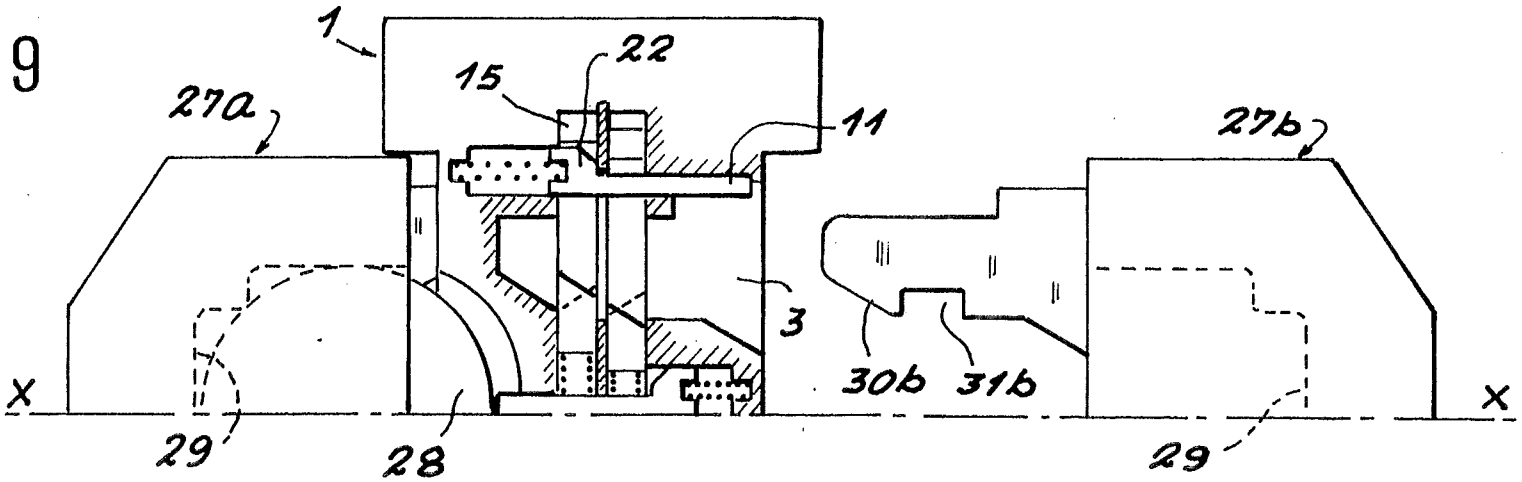
FIGS. 9 to 13 schematically represent a succession of stages of the freeing of a key bearing a consignment coin resulting from the insertion of a key with no consignment coin.

In reference to FIG. 8 after complete withdrawal of the key **27*b*, the bar 15*b* of the catch 15 is engaged in the recess 31*a* of the key 27*a*. The catch 15, whose parallelepipedal bar 15*a* is blocked by the head 22 of latch 11, is completely locked, thereby simultaneously ensuring the locking of key 27***a*, thus confining the consignment coin 28 in the housings 29 and 4 respectively of the box 1 and of the key 27*a*.

With reference to FIGS. 9 to 13, a key 27*a* with a consignment coin 28 is locked into a box 1, while a key 27*b*, whose consignment coin housing 29 is empty, is presented facing the insertion slot 3. Preferably, keys 27*a* and 27*b* are identical: each key comprises a coin housing 29 which is inside the U shape. The coin housing 29 may be removable to be replaced by a housing adapted to another form of consignment coin or similar token. In the position presented in FIG. 9, the head 22 of the latch 11 simultaneously locks the catch 15 and the key 27*a*.

Figure 10:
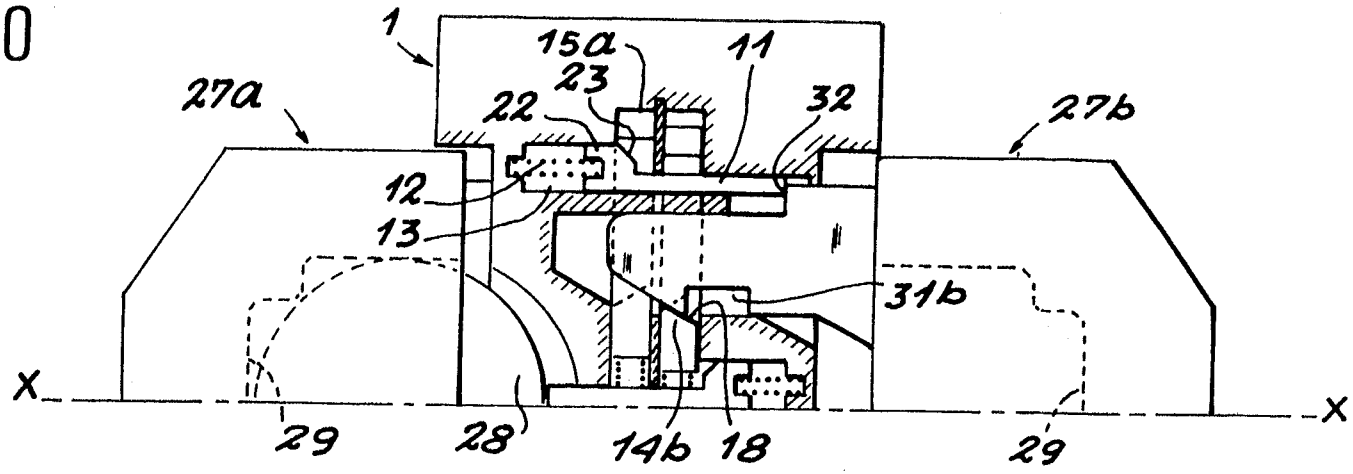

With reference to FIG. 10, the insertion of the key 27*b* causes the latch 11 to move back under the force exerted by the notch 32 of the key 27*b*, which has the effect of driving the head 22 back into the housing 13 and compressing the spring 12. In this position, the inclined plane 23 of the head 22 levels with the position the parallelepipedal bar 15*a*, in a position corresponding to the unlocking of the catch 15. The key 27*a* remains caught in the box 1, while the key 27*b* is not yet locked in by the inclined plane 18 of the bar 14*b* cooperating with the recess 31*b*.

Figure 11:
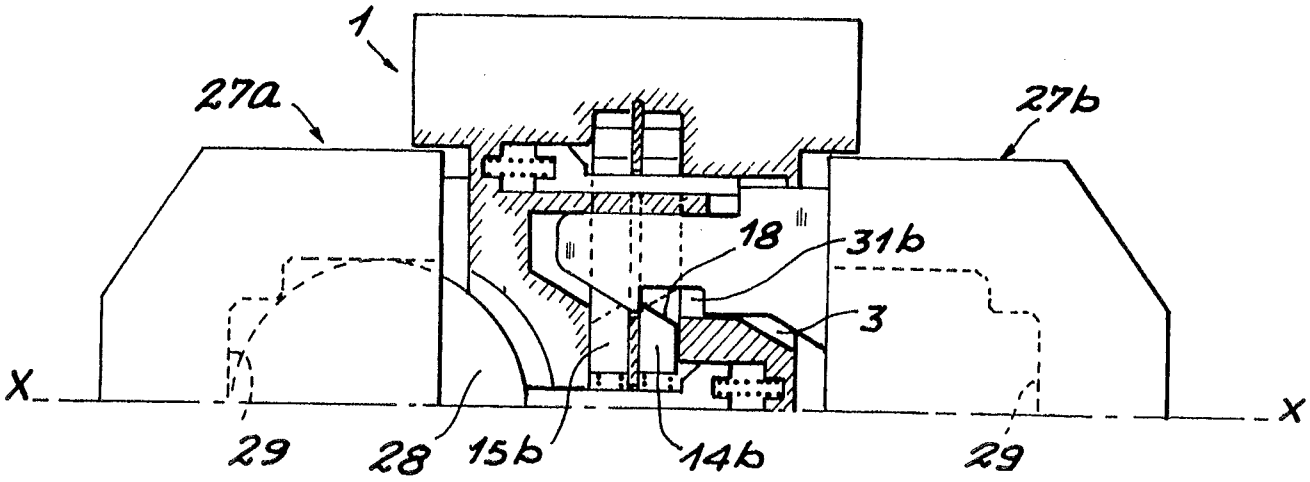

With reference to FIG. 11, a further pushing of the key 27*b* into the slot 3 brings about a position of simultaneous catching of keys 27*a*, 27*b* by bars 15*b* and 14*b* of the unlocked catches 14 and 15, an identical position to the one described in reference to FIG. 6. In this position, the plane 21 of the bar 15, after having slid on the engaging plane 30 of key 27*a*, is engaged in the recess 31*a* while the inclined plane 18 of the bar 14*b* is engaged in the recess 31*b* of the key 27*b*.

Figure 12:
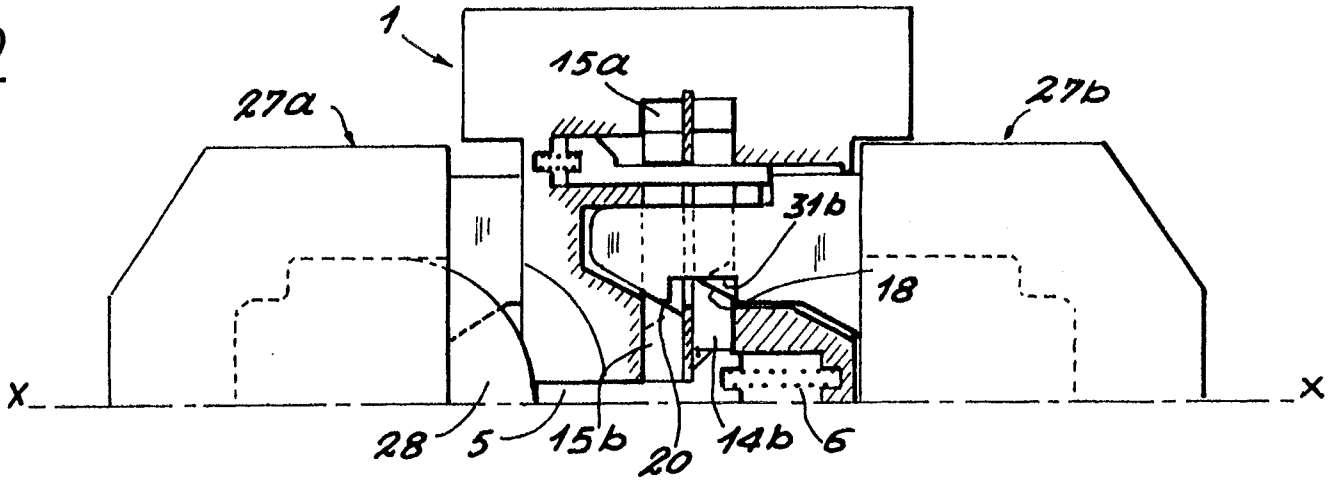

With reference to FIG. 12, by completely pushing in the key 27*b*, the inclined plane 30*b* presses against the inclined plane 20, thus causing the catch 15 to move back and compressing the spring 17, which has the effect of disengaging the inclined plane 21 from the recess 31*a* of key 27*a*. The key 27*a* thus disengaged is subjected to the thrust of the central latch 5 subjected to the action of the spring 6 which slackens in its housing 8, thus ejecting the key 27*a* from the box 1.

Figure 13:
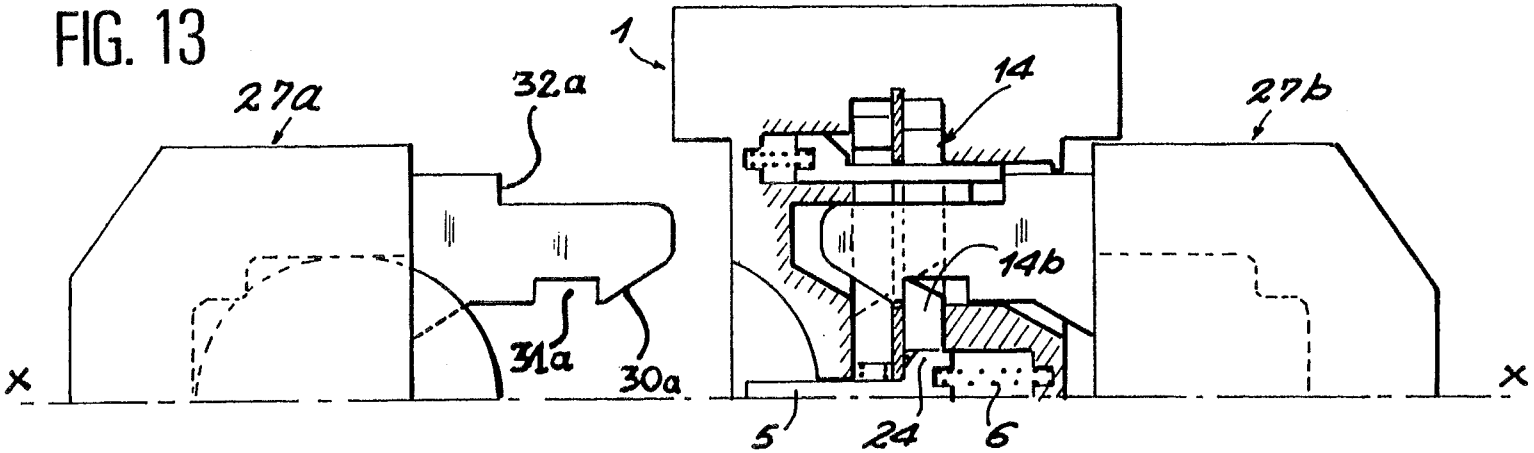

With reference to FIG. 13, the spring 6 applies the head 24 of the central latch 5 against the outside of the bar 14*b* of the H-shaped catch 14 and locks this H-shaped part 14 into position. The catch 14 engaged in the receiver 31*b* of key 27*b* thus retains the key in position. The cooperating effect of latch 5 and catch 14 thus ensures the perfect locking of the key 27*b* with no consignment coin.

The invention described with reference to a particular embodiment concerning a substantially symmetrical box fitted with two slots, disposed on opposite sides substantially parallel to one another, is not in any way limited to this embodiment, but, on the contrary, encompasses all modifications as regards shape and all other embodiments coming within the scope and spirit of the invention, i.e. in which the key becomes locked by way of a combination of translational movements oriented parallel and perpendicular to the direction of insertion of a key.

The invention is especially useful for the securing of a nestable cart comprising a consignment device and a key connected by chain or similar flexible link to the nestable cart. However, all other uses relating to consignment by means of a coin or token inserted into the receiver of a key adapted for this purpose are an integral part of this invention.

We claim:

1. In a coin consignment device comprising a box with first and second slots capable of receiving corresponding first and second keys by insertion of said keys into said slots from opposite directions, said box being shaped to receive said first key fitted with a receiver for a consignment coin so that the insertion of said second key unlocks said first coin-bearing key locked into said first slot, leaving said second key locked into position in said second slot; the improvement comprising at least one key catching means translatable rectilinearly substantially perpendicularly to said key insertion directions, and at least one means for locking said catching means translatable rectilinearly substantially parallel to said key insertion directions.

2. The device as claimed in claim 1, wherein the key slots are disposed on two opposite sides of the box.

3. The device as claimed in claim 1, wherein said slots are substantially symmetrical in relation to a common longitudinal mid-plane perpendicular to said two slots.

4. The device as claimed in claim 1, wherein said box comprises a coin receiver complementary in shape with said coin receiver of said first key.

5. The device as claimed in claim 1, wherein said device is substantially symmetrical in relation to a longitudinal mid-plane of said device.

6. The device as claimed in claim 1, wherein upon insertion of said first key, the coin directly pushes a central latch entering into the coin receiver of said box, to unlock catching elements situated on either side of a longitudinal mid-plane of said device.

7. The device as claimed in claim 1, wherein each key comprises a coin receiver.

8. The device as claimed in claim 1, wherein said catching means comprises four H-shaped catches.

9. The device as claimed in claim 1, wherein said means for locking said catching means comprises a lateral locking element in the shape of a bar comprising a head provided with an inclined plane.

10. The device as claimed in claim 1, wherein a latch extends into said first key slot.

11. The device as claimed in claim 10, wherein said first key has a conformation bearing on said latch when said first key is inserted into said first slot.

12. The device as claimed in claim 1, wherein said first key has a general U shape, said coin receiver being situated within said U shape.

13. The device as claimed in claim 12, wherein said catching means includes an H-shaped catch having oppositely oriented inclined planes thereon, one of which inclined planes is engaged by said first key to move said H-shaped catch perpendicular to said key insertion directions and the other of which inclined planes is engageable with the said second key to move said H-shaped catch in the same said direction perpendicular to said key insertion directions.

14. The device as claimed in claim 1, wherein said catching means comprises at least one H-shaped part between the branches of which passes a lock cooperating with an associated retracting spring means.

15. The device as claimed in claim 14, wherein said catching means comprises two independent H-shaped parts between the branches of which pass two locking elements on either side of the middle bar of the H.

16. The device as claimed in claim 14, wherein two said H-shaped parts are drawn back into position by laterally supported spring means and cooperate with at least one lateral latch.

17. The device as claimed in claim 14, wherein said H shape comprises one bar-shaped leg and another leg comprising two inclined inner planes oriented in opposite directions to one another and corresponding to inclined key-engaging planes.

18. The device as claimed in claim 17, wherein a space corresponding to one inclined plane is smaller than the space associated with the inclined plane oriented in the opposite direction.

19. A nestable cart comprising a coin consignment device comprising a box with first and second slots capable of receiving corresponding first and second keys by insertion of said keys into said slots from opposite directions, said box being shaped to receive said first key fitted with a receiver for a consignment coin so that the insertion of said second key unlocks said first coin-bearing key locked into said first slot, leaving said second key locked into position in said second slot; at least one key catching means translatable rectilinearly substantially perpendicularly to said key insertion directions, and at least one means for locking said catching means translatable rectilinearly substantially parallel to said key insertion directions, and a flexible link connecting said first key to said cart.

* * * * *